United States Patent [19]

Marran

[11] 4,261,299

[45] Apr. 14, 1981

[54] WOUND BOILER

[76] Inventor: John D. Marran, Overleigh Rd., Bernardsville, N.J. 07924

[21] Appl. No.: 58,486

[22] Filed: Jul. 18, 1979

[51] Int. Cl.[3] ..... F22B 11/00

[52] U.S. Cl. ..... 122/134; 122/261

[58] Field of Search ..... 122/134, 261, 135 R, 122/233

[56] References Cited

U.S. PATENT DOCUMENTS

| | | | |
|---|---|---|---|
| 1,339 | 9/1839 | DeWitt | 122/134 |
| 4,188,917 | 2/1980 | Asman | 122/134 |

FOREIGN PATENT DOCUMENTS

| | | | |
|---|---|---|---|
| 432034 | 7/1926 | Fed. Rep. of Germany | 122/134 |
| 611 | of 1906 | United Kingdom | 122/134 |

*Primary Examiner*—Edward G. Favors

*Attorney, Agent, or Firm*—Norman N. Popper; Daniel H. Bobis

[57] ABSTRACT

A wound boiler having an elongated hollow slab wound about a horizontal axis and the inner convolution defining a firebox and the outer convolutions defining a combustion gas passage leading to an exhaust.

6 Claims, 5 Drawing Figures

WOUND BOILER

BACKGROUND OF THE INVENTION

1. Field of the Invention:

This invention relates to a new and improved boiler and particularly to a boiler composed of an elongated generally rectangular hollow slab wound about a horizontal axis to define internally a body for holding a heat exchange medium therein, and externally defining a firebox and an exhaust gas passage between adjacent convolutions, leading the products of combustion from the firebox to an exhaust stack. The term "boiler" is not used in any limiting sense, but includes any fluid heater, such as is often referred to as a steam or hot water boiler, or furnace, in which the fluid is heated by burning fuel and by the hot products of combustion.

One of the particular objects of this invention is to provide a boiler in which the firebox is arranged to be surrounded on the sides by the heat exchange medium, and heat exchange medium flow occurs with controlled velocity and in a direction countercurrent to combustion gases.

Another object is to provide a boiler in which the velocity and direction of combustion gases may be controlled countercurrent to heat exchange medium.

A further object is to provide a boiler with a minimum external surface exposed to high temperature products of combustion.

A still further object is to provide external surfaces of a boiler cooled by the lowest temperature level of heat exchange medium.

Another object is to minimize the volume of heat exchange medium residing in the boiler.

The arrangement of a boiler in the configuration described renders particularly effective heat transfer, is suited to intermittent operation common to many boiler applications and has other novel advantages which will be apparent from the following description. 2. Prior Art:

It is known to form boilers out of tubular members wound in a plurality of convolutions to define a firebox and products of combustion passage. The helix so formed is usually disposed about a vertical axis. The circulation of heat exchange media, such as water, may be drastically attenuated by reason of the excessive length of the coils. Flow of products of combustion relative to heat exchange media is difficult to control, and are not truly counter to each other, thus heat transfer is not at maximum efficiency.

The volume of heat exchange medium in the boiler may be very large, and excessive energy may be consumed in causing the medium to traverse the long tube length.

In addition, horizontal boilers of the "Scotch Marine" type are well known in the art. Flow of products of combustion is generally through round tubes, frequently with turbulence inducers inserted to improve heat transfer. Efforts have also been made to improve heat transfer by making oval tubes to increase heat transfer area in relation to inside cross section area of the tubes. While these improvements have increased the efficiency of the performance of this type boiler, on the products of combustion, yet water flow remains generally uncontrolled, and not counter to products of combustion flow.

While the firebox is contained internally within the boiler, the inside of large exterior surfaces are frequently exposed to high temperatures of the products of combustion. In addition, exchange medium backed external surfaces are exposed to temperatures at or close to highest temperature attained in the boiler for this fluid. The combination permits considerable surface heat losses to occur.

While the "Scotch Marine" or similar designs are generally considered to have small water storage, the volume in reality is quite large and retains considerable unusable energy on each shutdown in intermittent service which frequently is lost during the standby cycle, through room air flow into the firebox, through the boiler and up the exhaust stack taking with it heat from the boiler inner surfaces as well as external heat loss from outside surfaces to the room.

SUMMARY OF THE INVENTION

It has been found that a boiler can be constructed of a wound elongated generally rectangular hollow slab by wrapping it around a horizontal axis so that the inner convolution defines a firebox. Each successive convolution defines a product-of-combustion exhaust passage.

The thickness of the slab can be arranged so that the volumetric capacity of the wound boiler can be properly dimensioned. With limited thickness, small liquid capacity may be utilized for efficient operation. In addition, dimensions may be increased to have much greater volumetric capacity if the volume (energy) requirements are greater.

The firebox (combustion chamber) may be sufficiently large as to complete combustion prior to passage into gas passages leading to the exhaust, while simultaneously accomplishing heat transfer very effectively through radiation and convection to the inner convolution.

The passages defined by the succeeding convolutions may be arranged in such a manner to maintain proper velocity for good heat transfer to the cooling products of combustion, without the use of baffles. Flow area can be varied and heat transfer surface can be increased favorably in relation to inside cross section areas. Flow is counter to heat exchange medium. The products of combustion thus traverse a considerable distance prior to reaching the exhaust port, wherein most available energy can be extracted prior to discharge to the exhaust stack.

The last convolution of the wound boiler, which forms the exterior surface, receives the lowest temperature heat transfer medium, and is the coolest, and similarly cools the products of combustion passing inside to the lowest possible degree.

THE DRAWINGS

These objects and advantages as well as other objects and advantages may be obtained by the device shown by way of illustration in the drawings in which.

PREFERRED EMBODIMENT

Figure 4:
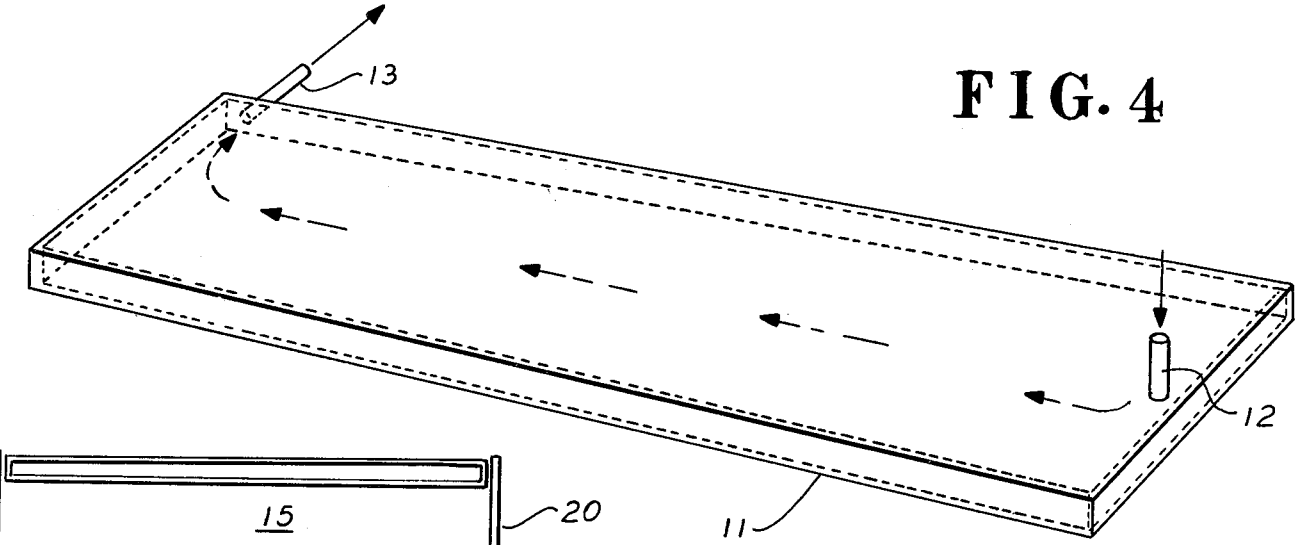
FIG. 4 is a perspective view of the slab boiler unwound.

Referring now to the drawings in detail, FIG. 4 presents an elongated generally rectangular hollow slab 11. The thickness, width, and length may be varied to suit the design. The thickness in particular may be varied dependent on the volumetric capacity of the boiler. In those constructions wherein it is desired to obtain rapid achievement of heat up and cool down, the slab 11 may be made relatively thin to arrive at temperature in the shortest space of time by reason of reduced heat exchange medium volumetric capacity. A heat exchanger intake port 12 is provided at one end of the rectangular slab 11 communicating with its interior. A heat exchange outlet port 13 is provided at the other end of the rectangular hollow slab and also communicating with the interior of the slab. The slab is hermetically sealed except for the intake port 12 and the outlet port 13.

Figure 1:
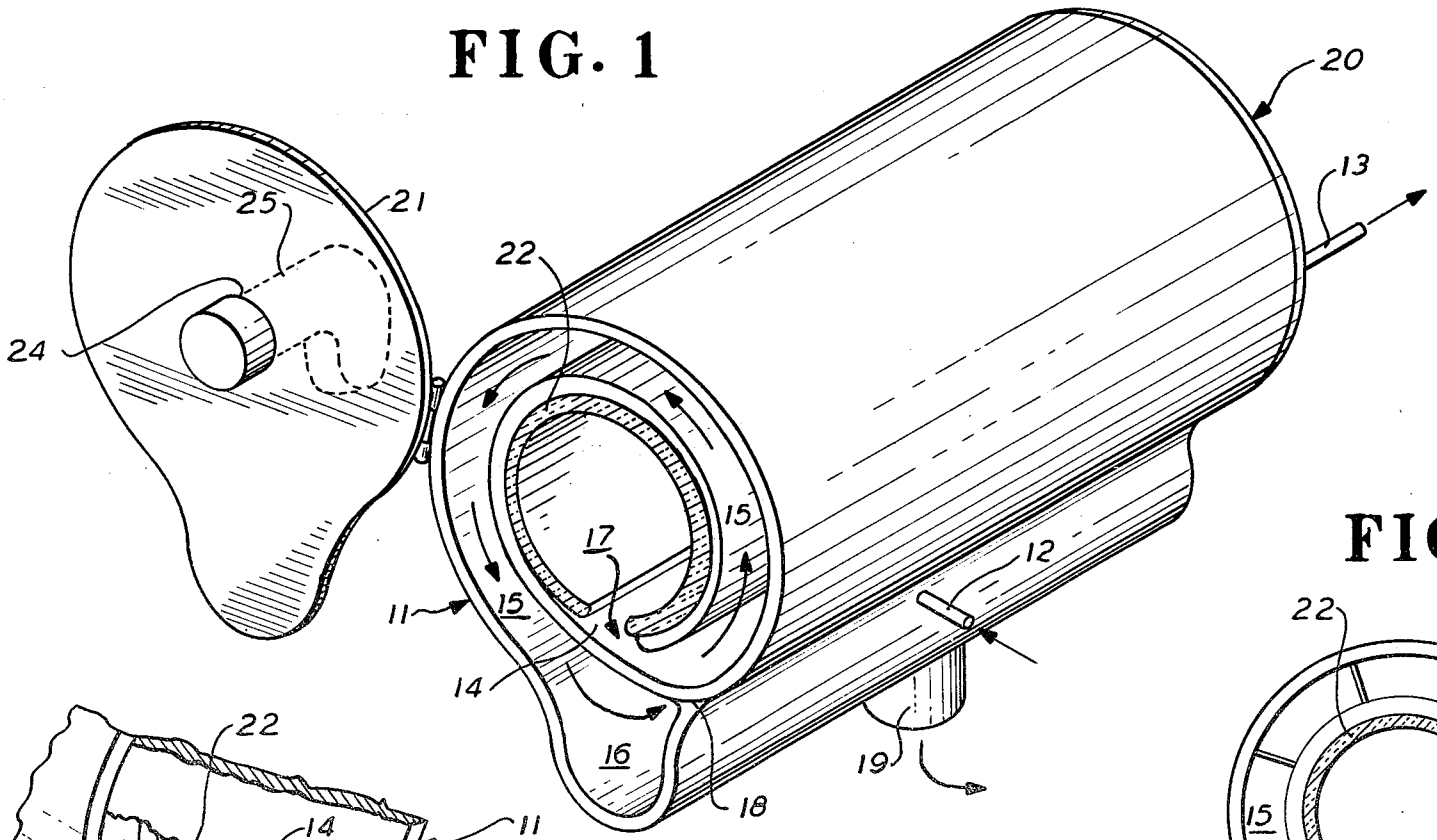
FIG. 1 is a perspective view of the horizontally wound slab boiler with the fire door to the firebox open.
Figure 2:
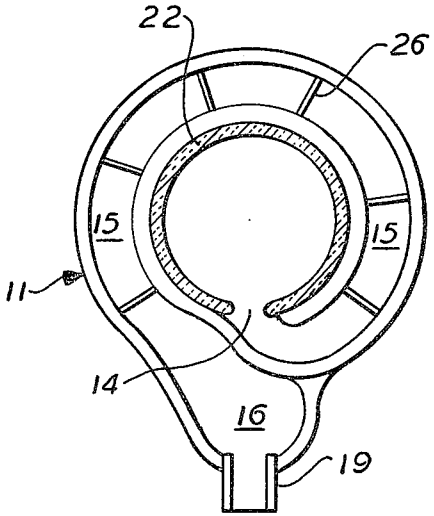
FIG. 2 is a vertical sectional view thereof.
Figure 3:
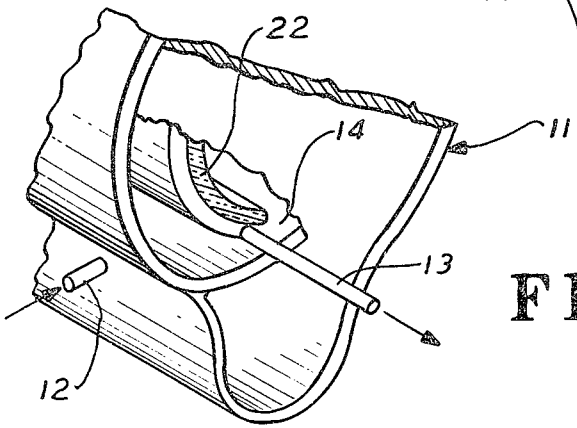
FIG. 3 is a partial vertical sectional view thereof.

In FIG. 1, the slab 11 is shown wound upon itself around a horizontal axis in a plurality of convolutions, with the intake port 12 at the outer end of the convolutions and the outlet port 13 at the inner end of the convolutions.

The innermost convolution defines a horizontal elongated firebox 17. The innermost convolution and the next adjacent convolution of the slab 11 are disposed in a spaced relation to each other and define the exit 14 from the firebox 17 to convoluted passage 15 which conducts the combustion products to an expanded gas passage 16 at the end of the slab 11.

The end of slab 11, on the outer convolution is joined to the adjacent inner convolution at 18 to define a longitudinal closure.

A combustion product's exhaust port 19 communicating with the expanded gas passage 16 passes through slab 11 and provides a means for venting the products of combustion to an exhaust stack.

spacers 26 support and define the distance between adjacent convolutions.

A closure 20 defines an end wall at one side of convolutions formed by slab 11, and a hinged door 21 defines the closure at the other side of the convolutions to contain combustion and products of combustion within the defined passages 17, 15, 16.

Closure 21 contains an opening 24 for introduction of combustible materials to the firebox and serves to mount a burner 25.

The firebox 17 may be lined with refractory material 22 to improve the combustion process or the firebox may be sized to permit proper combustion without a refractory lining.

The refractory material may extend beyond the strict firebox area and line the convolutions to permit combustion to be completed within the passages 15, should a particularly compact design be required.

Refractory material so placed may achieve a high surface temperature for improved combustion, but cooled by the backup surface slab 11, it is kept sufficiently cool to minimize distortion and deterioration.

The exterior surfaces are properly insulated with material such as fiber glass in a usual manner to further minimize energy loss and enclosed in an ornamental jacket, neither of which are shown nor unusual to the invention.

Covers 20 and 21 may be suitably lined with insulating materials resistant to combustion temperature in appropriate locations to minimize heat loss to the cover and prevent covers from reaching excessive temperature.

It will be seen that this construction provides for flow of the heat exchange medium from inlet 12 at the outer convolution inward toward the firebox 17 and outlet 13, while the combustion process occurs in the innermost convolution (firebox 17) and products of combustion pass outward, 14, 15, 16, toward the outermost convolution in true counterflow to the heat exchange medium.

Effective heat transfer is achieved in a simple way without the use of baffles, turbulators or other devices which tend to deteriorate at elevated temperatures experienced in normal combustion processes and also make cleaning of passages difficult.

Heat exchange medium flow area and flow rates can be arranged for economical energy use, while maintaining a relative low temperature of slab 11. This permits slab 11 to be made of economical materials which effectively resist temperatures expected in the process.

Interior surfaces are readily available for cleaning or inspection by opening the hinged door 21.

The length of slab 11 and the number of convolutions may be arranged to reduce exhaust gas temperature to whatever level desirable and may closely approach the temperature of incoming heat exchange medium 12.

The wound boiler arranged in the manner described acts to provide restricted passages which minimize room air flow caused by exhaust stack draft when boiler is between operating cycles preventing heat to be removed from the boiler to the exhaust stack.

The multiple horizontal circular paths and tendency of hot air to rise in each convolution further reduces the draft induced room air flow to extract energy from the boiler in between operating cycles.

It is to be understood that the invention is not limited as to the number of convolutions of the slab 11, for it may be desirable, due to increased energy costs, to increase the number of convolutions to permit exhaust gases to be cooled by incoming heat exchange medium below their dewpoint. This permits recovery of considerable additional energy normally permitted to pass to the exhaust stack.

This is known to tend to cause corrosion of materials. In this construction, the true counterflow and construction should require the lowest temperature portion of slab 11 to be made of materials which resist moisture and corrosion at lower temperatures experienced in the outer convolutions, while the portion exposed to the higher temperatures and to no condensation in the inner convolutions could be made of traditional materials.

The location of the exhaust passage 19 makes it particularly suited to drain the accumulation of moisture which occurs in this construction.

Figure 5:
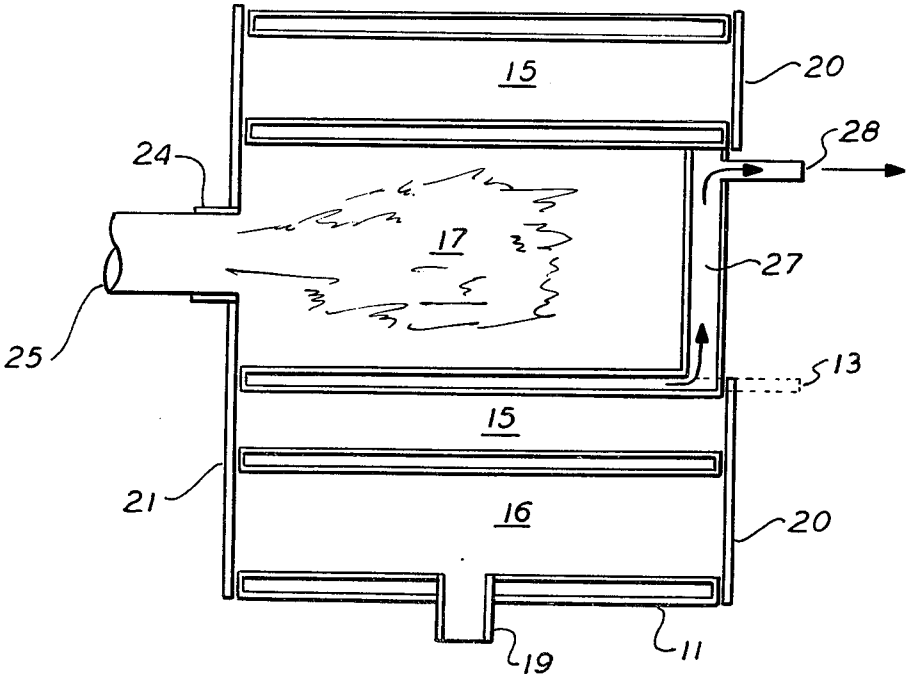
FIG. 5 is a longitudinal vertical sectional view of a variant form of boiler.

A further improvement on the basic invention and consistent with the true counterflow system and maintaining exterior surfaces at the lowest temperature is shown in FIG. 5.

A sealed chamber 27 replaces cover 20 at the innermost convolution which forms the firebox 17. The normal heat exchange medium outlet 13 is routed through this chamber 27 to outlet 28 to absorb additional heat from the firebox and also reduce surface temperature of area of cover 20 replaced.

In some instances, it may be desirable to cool the firebox surfaces to the lowest possible level to enable the use of less expensive material to be used. In these cases, introduction of the heat exchange medium at the normal discharge 13 and discharging it at the normal inlet 12 will provide a lower temperature of slab 11 at the firebox convolution and may permit use of alternate materials.

In instances where low exhaust products of combustion temperatures are required for maximized energy removal, a possibility of condensation exists. It may be desirable to do as above so that slab 11 surface temperature in the outermost convolution is maintained nearer to the discharge temperature of the heat exchange medium and surface condensation will be prevented.

This construction provides a highly efficient boiler generally smaller in size and using less materials than conventional designs. It may be constructed in various dimensions in order to accommodate the needs of any system.

What is claimed is:

1. A wound boiler comprising, (a) an elongated generally rectangular hollow slab, (b) a heat exchanger intake port at one end of the hollow slab and communicating with its interior.

(c) a heat exchanger outlet port at the other end of the rectangular slab and communicating with its interior, (d) the slab wound upon itself around a horizontal axis, in a plurality of convolutions with the intake port at the other end of the convolutions and the outlet port at the inner end of the convolutions, (e) a horizontal elongated firebox defined by the innermost convolution, (f) the innermost convolution and the next adjacent outer convolution disposed in spaced relation to each other and defining the entrance to a passage for combustion products to be conducted to a products-of-combustion passage, (g) successive convolutions disposed in spaced relation to each other and defining a products-of-combustion passage to be conducted to an expanded dimension exhaust gas passage, (h) an expanded dimension exhaust gas passage defined by the hollow slab at the bottom of the wound boiler, (i) the outer end of the hollow slab convolution joined to the adjacent inner convolution to define a longitudinal closure, (j) a combustion product's exhaust port communicating with the expanded dimension exhaust gas passage, (k) a closure at each side of the convolutions of the slab, (i) means for introducing combustion materials into the firebox through the closure at one side of the convolutions.

2. A wound boiler comprising the device according to claim 1 in which heat exchange medium and products of combustion flow counter to each other.

3. A wound boiler comprising the device according to claim 1 in which a lining of refractory material is applied at least to the firebox.

4. A wound boiler comprising the device according to claim 1 in which the slab is constructed of material highly resistent to high temperatures and products of combustion.

5. A wound boiler according to claim 1 in which the slab is constructed of a material or materials having a high coefficient of thermal conductivity.

6. A wound boiler according to claim 1 in which the heat exchange medium enters the center and exits the periphery and flows in same direction as products of combustion.

* * * * *